US009999248B2

(12) United States Patent
Liu

(10) Patent No.: US 9,999,248 B2
(45) Date of Patent: Jun. 19, 2018

(54) ELECTRONIC CIGARETTE AND METHOD FOR ASSEMBLING ELECTRONIC CIGARETTE

(71) Applicant: Shenzhen Smoore Technology Limited, Shenzhen, Guangdong (CN)

(72) Inventor: Pingkun Liu, Shenzhen (CN)

(73) Assignee: Shenzhen Smoore Technology Limited, Shenzhen (CN)

( * ) Notice: Subject to any disclaimer, the term of this patent is extended or adjusted under 35 U.S.C. 154(b) by 560 days.

(21) Appl. No.: 14/685,626

(22) Filed: Apr. 14, 2015

(65) Prior Publication Data

US 2016/0150823 A1 Jun. 2, 2016

(30) Foreign Application Priority Data

Nov. 28, 2014 (CN) ..... 2014 1 0714224

(51) Int. Cl.
*A24F 47/00* (2006.01)
*H05B 3/46* (2006.01)

(52) U.S. Cl.
CPC ..... *A24F 47/008* (2013.01); *H05B 3/46* (2013.01)

(58) Field of Classification Search
CPC ..... A24F 47/008; H05B 3/46; H05B 3/44; H05B 1/0244; H05B 2203/022; H05B 2203/017; H05B 2203/021; H05B 2203/014; H05B 3/06; H05B 3/04; H05B 3/00; H01R 13/66; H01R 13/2421; H01R 13/703; H01R 2103/00
See application file for complete search history.

(56) References Cited

U.S. PATENT DOCUMENTS

| | | | | |
|---|---|---|---|---|
| 9,675,118 | B2 * | 6/2017 | Chen | A24F 47/008 |
| 9,814,272 | B2 * | 11/2017 | Li | B67D 99/00 |
| 2011/0011396 | A1 * | 1/2011 | Fang | A24F 47/008 128/202.21 |
| 2011/0304282 | A1 * | 12/2011 | Li | A24F 47/008 315/362 |
| 2013/0228191 | A1 * | 9/2013 | Newton | A24F 47/008 131/329 |
| 2013/0319438 | A1 * | 12/2013 | Liu | A24F 47/008 131/329 |

* cited by examiner

*Primary Examiner* — Lore Ramillano Jarrett

(57) ABSTRACT

An electronic cigarette and a method for assembling the electronic cigarette are provided. The electronic cigarette includes an atomizer device mounting base, at least one conductive pipe, an atomizer device, and a battery device. The conductive pipe includes a first open end, a second open end, and a partition wall disposed within the middle of the conductive pipe to separate the first open end from the second open end. The atomizer device includes a first pluggable member being inserted into and electrically connected to the first open end. The battery device includes a second pluggable conductive member being inserted into and electrically connected to the second open end. When assembled, the atomizer device, the atomizer device mounting base, and the battery device can be connected together by employing an insertion method directly, thus the assembly process can be simplified, and the leakage of the liquid solution can be prevented.

16 Claims, 3 Drawing Sheets

ELECTRONIC CIGARETTE AND METHOD FOR ASSEMBLING ELECTRONIC CIGARETTE

CROSS-REFERENCE TO RELATED APPLICATIONS

The present application claims the benefit of Chinese application No. 201410714224.9 filed on Nov. 28, 2014, the contents of which are hereby incorporated by reference.

BACKGROUND

1. Technical Field

The present disclosure relates to products for smokers, and more particularly relates to an electronic cigarette and a method for assembling an electronic cigarette.

2. Description of Related Art

In word overall consumption having a greater dependence of cigarettes is greater. When cigarettes are lit for smoking, impurities, such as nicotine and tar in the cigarettes for example, will be inhaled into lungs of smokers. Not only these harmful substances, such as nicotine and tar for example, do great harm to smokers, but also environment is contaminated and fire is easily caused due to burning cigarettes.

For cigarettes in related art, a lead passes through a mounting base of an atomizer device with two ends respectively connected to conductive connectors of the atomizer device and a battery device, to communicate the atomizer device with the battery device, which will result in complex assembly, decrease efficiency, and increase human cost. The conductive connector of the atomizer device contacts an absorption element, which will cause E-liquid in the absorption element to flow to one side of batteries along the conductive connector and the lead, result in E-liquid waste, and contamination to the batteries and other elements at the same time.

SUMMARY

The technical problem of the present invention is to provide an improved electronic cigarette and a method for assembling the electronic cigarette.

To overcome the above mentioned disadvantage, an electronic cigarette is provided. The electronic cigarette includes:

an atomizer device mounting base;

at least one conductive pipe extending longitudinally through the atomizer device mounting base, wherein the at least one conductive pipe includes a first open end, a second open end, and a partition wall, the partition wall is disposed within the middle of the at least one conductive pipe to separate the first open end from the second open end;

an atomizer device including at least one first pluggable conductive member, wherein the at least one first pluggable conductive member is inserted into and electrically connected to the first open end of the at least one conductive pipe; and a battery device including at least one second pluggable conductive member, wherein the at least one second pluggable conductive member is inserted into and electrically connected to the second open end of the at least one conductive pipe.

Preferably, the at least one conductive pipe includes a pair of conductive pipes extending longitudinally through the atomizer device mounting base respectively, each of the pair of conductive pipes includes opposite first open end and second open end, and a partition wall disposed within the middle of the conductive pipe, the partition wall separates the first open end from the second open end; the atomizer device includes a pair of first pluggable conductive members, the pair of first pluggable conductive members are respectively inserted into and electrically connected to the first open ends of the pair of conductive pipes; the battery device includes a pair of second pluggable conductive members, the pair of second pluggable conductive members are respectively inserted into and electrically connected to the second open ends of the pair of conductive pipes.

Preferably, the pair of conductive pipes are symmetrically arranged at the atomizer device mounting base.

Preferably, wherein the at least one conductive pipe are embedded into the atomizer device mounting base.

Preferably, the at least one conductive pipe are embedded into the atomizer device mounting base to form a whole structure by embedded injection molding.

Preferably, the internal walls of the first open end of the second end respectively define annular protruding portions sleeving the outer surfaces of the first pluggable conductive member and the second pluggable conductive member respectively, the protruding portion engages with the first pluggable conductive member by an interference fit.

Preferably, a partial cross sections or whole cross sections of the first open end and the second open end are flat, the first open end and the second open end respectively engage with the first pluggable conductive member and the second pluggable conductive member by an interference fit.

Preferably, end portions of the first open end and the second open end respectively define contracted holes for clamping the first pluggable conductive member and the second pluggable conductive member respectively.

Preferably, ends of the first pluggable conductive member and the second pluggable conductive member respectively define tapered or frustum-shaped guiding portions.

A method for assembling an electronic cigarette is also provided. The method includes:

providing at least one conductive pipe, wherein the at least one conductive pipe includes a first open end, a second open end, and a partition wall, the partition wall is disposed within the middle of the at least one conductive pipe to separate the first open end from the second open end;

the at least one conductive pipe extending longitudinally through an atomizer device mounting base;

providing an atomizer device including at least one first pluggable conductive member, wherein the at least one first pluggable conductive member is inserted into and electrically connected to the first open end of the at least one conductive pipe.

Preferably, the at least one conductive pipe are embedded into the atomizer device mounting base to form a whole structure by embedded injection molding.

Preferably, the method further including:

exerting an external force to deform the first open end, to allow the first open end to clamp the first pluggable conductive member tightly.

Preferably, the method further including:

providing a battery device including at least one second pluggable conductive member opposite to the atomizer device mounting base, wherein the at least one second pluggable conductive member is inserted into and electrically connected to the second open end of the at least one conductive pipe.

Preferably, the method further including:

exerting an external force to deform the second open end, to allow the second open end to clamp the second pluggable conductive member tightly.

The electronic cigarette described above has beneficial effects as below: the conductive pipe in the present invention is inserted into the atomizer device mounting base, and a partition wall is disposed within the middle of the conductive pipe, thus when the electronic cigarette is assembled, the atomizer device, the atomizer device mounting base and the battery device are connected together by using inserting way directly, thus the assembling process is simplified, the assembly efficiency is enhanced, and the cost is down, and further prevent liquid solution from leaking from the first pluggable conductive member and the conductive member to the other end of the conductive member, whereby liquid solution is saved, the internal environment of the electronic cigarette is purified, and the grade of electronic cigarette is improved.

BRIEF DESCRIPTION OF THE DRAWINGS

In combination drawings with embodiments below to further illustrate the present invention, in the drawings.

DETAILED DESCRIPTION

For better understanding technical features, purpose and effect of the present invention, the following explanation in combination with drawings provides specific details for these embodiments of the present invention.

Figure 1:
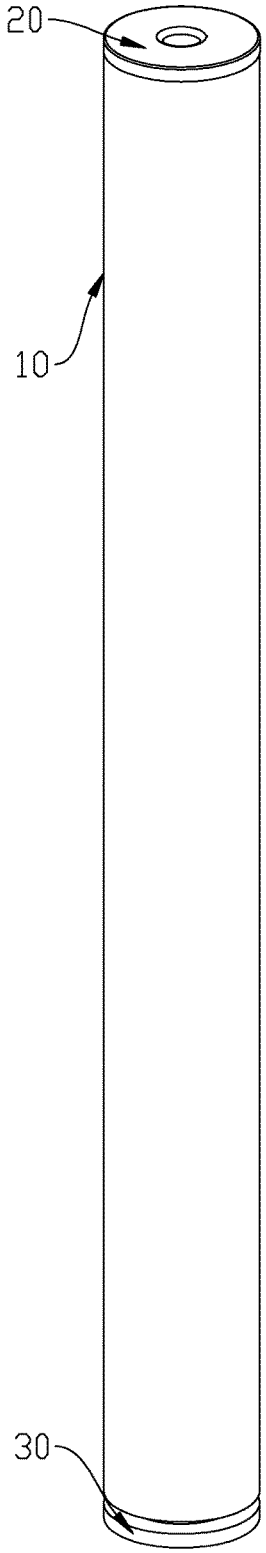
FIG. 1 is an isometric view of an electronic cigarette, in accordance with an exemplary embodiment of the present invention.
Figure 2:
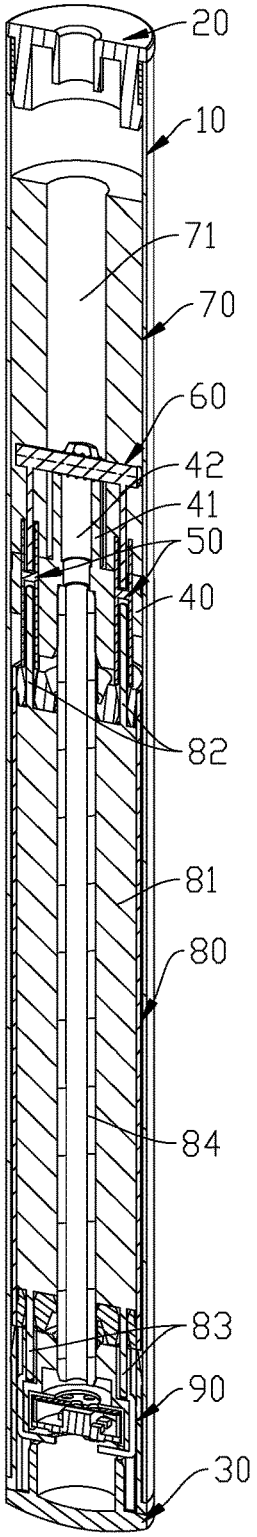
FIG. 2 is a cross-sectional view of the electronic cigarette of FIG. 1, along an axis of the electronic cigarette of FIG. 1.
Figure 3:
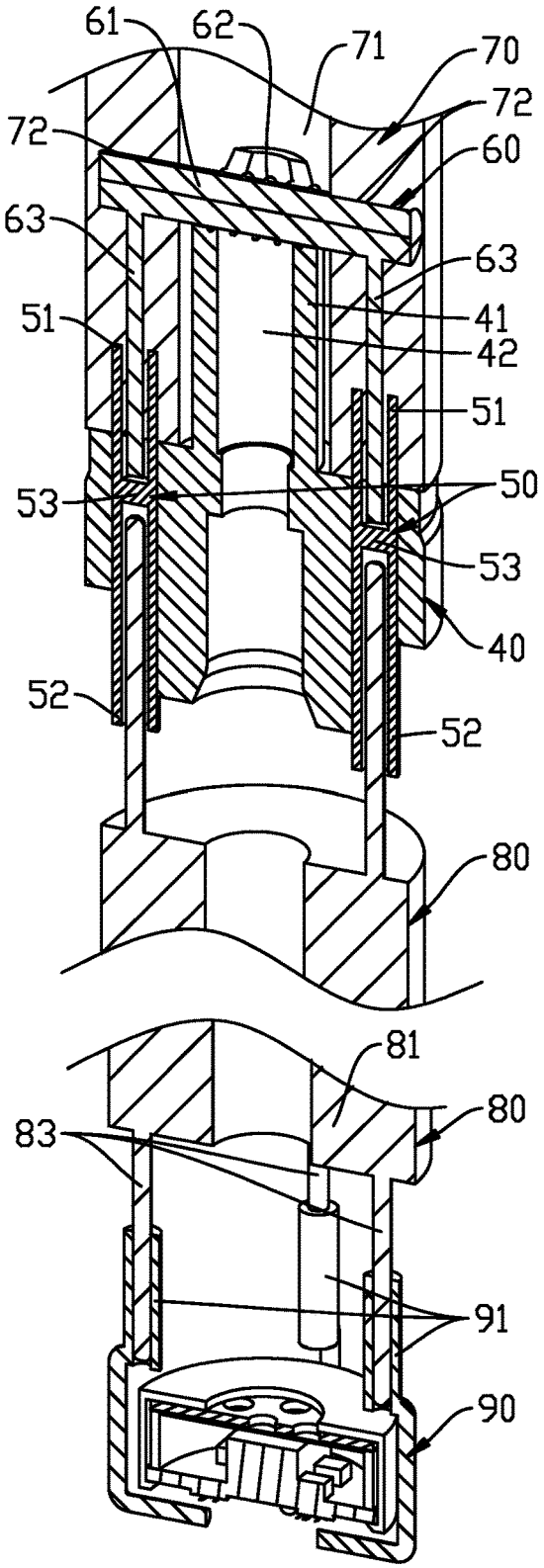
FIG. 3 is an assembly view of an atomizer device, a liquid-absorbing member, an atomizer device mounting base, conductive pipes, a battery device, and an air switch of FIG. 2.

Referring to FIGS. 1-3, an electronic cigarette in a preferable embodiment includes a housing 10, a mouthpiece 20, an end cover 30, an atomizer device mounting base 40, a pair of conductive pipes 50, an atomizer device 60, a liquid reservoir 70, a battery device 80, and an air switch 90. The mouthpiece 20 and the end cover 30 cover opposite ends of the housing 10 respectively. The atomizer device mounting base 40, the conductive pipes 50, the atomizer device 60, the liquid reservoir 70, the battery device 80, and the air switch 90 are all disposed within the housing 10.

Furthermore, the atomizer device mounting base 40 is arranged at the middle of the housing 10, and engages with the internal wall of the housing 10. The atomizer device mounting base 40 provides a supporting post 41 for supporting the atomizer device 60. The middle of the supporting post 41 defines a center hole 42 extending through the atomizer device mounting base 40.

Figure 4:
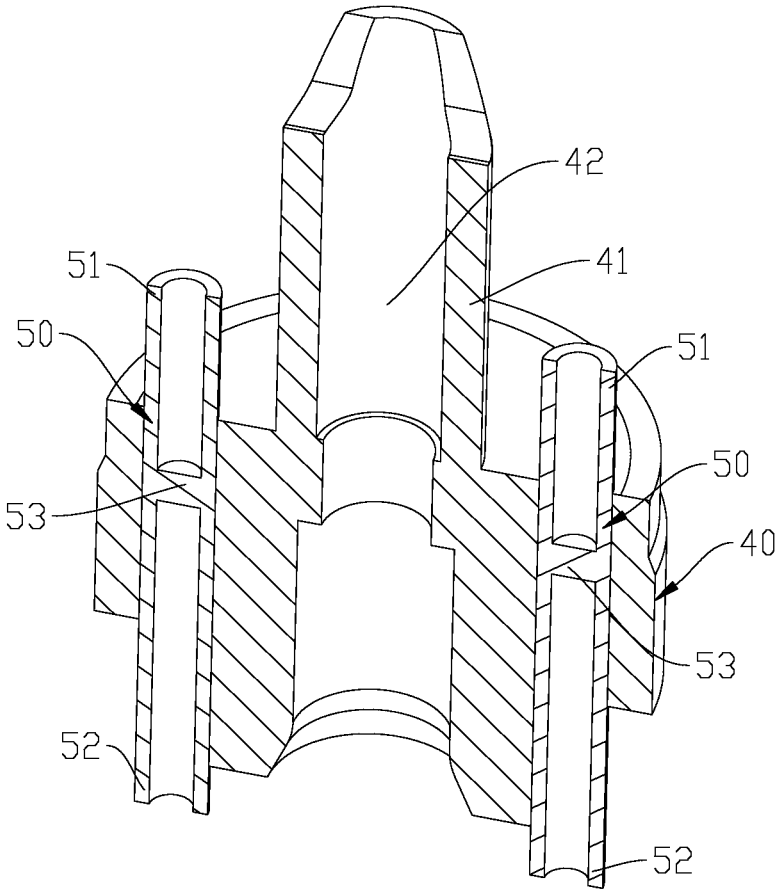
FIG. 4 is an assembly view of the conductive pipes and the atomizer device mounting base of FIG. 2.

Referring to FIG. 4, the pair of conductive pipes 50 extend longitudinally through the atomizer device mounting base 40 respectively. Furthermore, the conductive pipes 50 are embedded into the atomizer device mounting base 40, to ensure that the outer wall of the conductive pipes 50 mates with the atomizer device mounting base 50. Preferably, the conductive pipes 50 are embedded into the atomizer device mounting base 40 to form a whole structure by embedded injection molding, to make seamless engagement therebetween to guarantee effective sealing.

Each conductive pipe 50 includes opposite first open end 51 and second open end 52, and a partition wall 53 disposed within the conductive pipe 50. The partition wall 53 separates the first open end 51 from the second open end 52. In other embodiments, an occlusion can also be arranged in the middle of the conductive pipes 50, to separate the first open end 51 from the second open end 52, or the occlusion is arranged in the middle of one of the conductive pipes 50 and the partition wall 53 is arranged in the middle of the other conductive pipe 50.

Referring to FIGS. 2 and 3, the atomizer device 60 is mounted to the atomizer device mounting base 40, and is arranged between the atomizer device mounting base 40 and the mouth piece 20, for atomizing the liquid solution known as e-liquid. The liquid reservoir 70 is mounted to the atomizer device mounting base 40, and coils around the atomizer device 60 for storing liquid solution.

In some embodiments, the atomizer device 60 may include a liquid-absorbing member 61, a heating member 62, and a pair of first pluggable conductive member 63. The liquid-absorbing member 61 in some embodiments is substantially cylindrical, and is made of material with good capillary force, such as fiberglass. The liquid-absorbing member 61 is mounted to the supporting post 41 with opposite ends extending into opposite sides of the liquid reservoir 70 respectively, to absorb liquid solution in the liquid reservoir 70. In some embodiments, the heating member 62 may include metal heating wire. The metal heating wire coils around the middle portion of the liquid-absorbing member 61. The first pluggable conductive member 63 are arranged at opposite ends of the liquid absorbing member 61, and are electrically connected to the heating member 62 respectively.

The liquid reservoir 70 in some embodiments may be cylindrical, and is made from material having excellent liquid-absorbing performance, such as, cotton. The liquid reservoir 70 has a central through hole 71. The central through hole 71 communicates with the center hole 42 to allow air to flow through. The outer diameter of the liquid reservoir 70 matches with the inner diameter of the housing 10, to allow the liquid reservoir 70 to be tightly plugged into the housing 10. The inner diameter of the liquid reservoir 70 matches with the diameter of the supporting post 41 of the atomizer device mounting base 40, to allow the liquid reservoir 70 to tightly sleeve on the supporting post 41.

Furthermore, the liquid reservoir 70 further includes a receiving portion 72 for allowing opposite ends of the liquid-absorbing member 61 of the atomizer device 60 to tightly extend therethrough, whereby the liquid solution in the liquid reservoir 70 can flow into the middle of the liquid-absorbing member 61 by passing through opposite ends of the liquid-absorbing member 61.

In some embodiments, the first pluggable conductive member 63 of the atomizer device 60 is embedded into the liquid reservoir 70 and further extends out of the bottom end surface of the liquid reservoir 70. The first pluggable conductive member 63 is inserted into and electrically connected to the first open end 51 of the conductive pipe 51. The partition wall 53 can prevent the liquid solution in the liquid reservoir 70 from leaking to the second open end 52 along the first pluggable conductive member 63 and the conductive pipe 50, to decrease a waste of the liquid solution. The conductive pipes 50 are embedded into to the atomizer device mounting base 40 to form a whole structure by embedded injection molding, effectively preventing the leakage of the liquid solution.

Preferably, the first pluggable conductive member 63 includes a cylindrical structure matching with the internal hole of the first open end 51. A tapered guiding portion (not shown) is arranged at an end portion of the first pluggable conductive member 63, to enable the first pluggable conductive member 63 to be inserted into the conductive pipe 50 easily. Certainly, the first pluggable conductive member 63 can be sheet-shaped or other structure-shaped, and the guiding portion can be frustum-shaped. The end portion of the first open end 51 defines a contracted hole (not shown). After the first pluggable conductive member 63 is inserted into the first open end 51, the first open end 51 is clamped by a clamp forceps to form the contracted hole, whereby the first pluggable conductive member 63 is clamped to guarantee reliability of electrical connection between the first pluggable conductive member 63 and the first open end 51.

In some other embodiments, the internal wall of the first open end 51 defines an annular protruding portion (not shown) sleeving the outer surface of the first pluggable conductive member 63, the protruding portion engages with the first pluggable conductive member 63 by an interference fit, to guarantee reliability of electrical connection between the first pluggable conductive member 63 and the first open end 51. Alternatively, a partial cross section or a whole cross section of the first open end 51 may be flat, the first open end 51 engages with the first pluggable conductive member 63 by an interference fit to clamp the first pluggable conductive member 63, to guarantee reliability of electrical connection between the first pluggable conductive member 63 and the first open end 51.

Referring to FIGS. 2 and 3 again, the battery device 80 is arranged between the atomizer device mounting base 40 and the end cover 30, and is electrically connected to the atomizer device 60 to supply power to the atomizer device 60 to atomize the liquid solution. In some embodiments, the battery device 80 may include two second pluggable conductive members 82 secured to an end of the cylinder body 81, three third pluggable conductive members 83 secured to the other end of the cylinder body 81, and an air flow pipe 84 extending axially through the cylinder body 81. Wherein, the second pluggable conductive members 82 face the atomizer device mounting base 40, and the third pluggable conductive members 83 face the air switch 90.

One of the second pluggable conductive members 82 is electrically connected to the anode of the battery device 80 directly, the other second pluggable conductive member 82 is electrically connected to one of the third pluggable conductive member 83 directly, and the rest of third pluggable conductive members 83 are electrically connected to the cathode and anode of the battery device 80, to supply power to the air switch 90.

In some embodiments, the end portion of the second pluggable conductive member 82 provides a tapered guiding portion (not shown), to enable the second pluggable conductive member 82 to be inserted into the conductive pipe 50 easily. Certainly, the guiding portion can be frustum-shaped. The end portion of the second open end 52 defines a contracted hole (not shown) for clamping the second pluggable conductive member 82. After the second pluggable conductive member 82 is inserted into the second open end 52, the second open end 52 is clamped by a clamp forceps to form the contracted hole, whereby the second pluggable conductive member 82 is clamped to guarantee reliability of electrical connection between the second pluggable conductive member 82 and the second open end 52.

In some other embodiments, the internal wall of the second open end 52 defines an annular protruding portion (not shown) sleeving the outer surface of the second pluggable conductive member 82, and the protruding portion engages with the second pluggable conductive member 82 by an interference fit, to guarantee reliability of electrical connection between the second pluggable conductive member 82 and the second open end 52. Alternatively, a partial cross section or a whole cross section of the second open end 52 may be flat, the second open end 52 engages with the second pluggable conductive member 82 by an interference fit to clamp the second pluggable conductive member 82, to ensure reliability of electrical connection between the second pluggable conductive member 82 and the second open end 52.

Preferably, the pair of conductive pipes 51 are symmetrically arranged at the atomizer device mounting base 40, and can be inserted into the first pluggable conductive member 63 and the second pluggable conductive member 82 when the atomizer device mounting base 40 rotates 180 degrees, to facilitate the assembly. In other embodiments, the pair of conductive pipes 51 can be asymmetrically arranged at the atomizer device mounting base 40, and a suitable angle may be found to carry out inserting action when assembled.

The air flow pipe 84 of the battery device 80 defines an air flow channel. The diameter of the cylinder body 81 matches with the inner diameter of the housing 10, to enable the cylinder body 81 to be tightly embedded into the housing 10. An end of the air flow channel 84 is connected to the center hole 42 of the atomizer device mounting base 40, and the other end of the air flow channel 84 is connected to the air switch 90, whereby air from the air switch 90 can be transmitted to the atomizer device mounting base 40. Due to the air flow pipe 84, air passing through the battery device 80 can flow through the air flow channel, and the size of the air flow channel is easily to be kept consistent, whereby the consistency of smoke amount of the product is improved.

In some embodiment, the air switch 90 is arranged between the battery device 80 and the end cover 30, and is electrically connected to the battery device 80, to detect whether or not air flows into the electronic cigarette and control the atomizer device 60 to be powered on/off. The air switch 90 includes three pluggable conductive bodies 91. The three pluggable conductive members 83 are plugged into the three pluggable conductive bodies 91 respectively. Wherein two of the third pluggable conductive members 83 electrically connected to the cathode and anode of the battery device 80 are electrically connected to two of the pluggable conductive bodies 91, to supply power to the air switch 90. The third pluggable conductive member 83 electrically connected to one of the second pluggable conductive members 82 is electrically connected to the air switch 90, and is further electrically connected to one of the other two pluggable conductive bodies 91 electrically connected to the anode by the air switch 90, thus is electrically connected to the battery device 80 indirectly.

The pluggable conductive body 91 is substantially tubular. The third pluggable conductive member 83 includes a cylindrical structure being inserted into the pluggable conductive body 91. The end portion of the third pluggable conductive member 83 provides a tapered guiding portion (not shown), to allow the third pluggable conductive member 83 to be inserted into the pluggable conductive body 91 easily. Certainly, the guiding portion of the third pluggable conductive member 83 can be frustum-shaped. The end portion of the pluggable conductive body 91 defines a contracted hole (not shown) for clamping the third pluggable conductive member 83. After the third pluggable conductive member 83 is inserted into the pluggable conductive body 91, the pluggable body 91 is clamped by a clamp forceps to form the contracted hole, whereby the third pluggable conductive member 83 is clamped to ensure reliability of electrical connection between the third pluggable conductive member 83 and the pluggable conductive body 91.

In some embodiments, the internal wall of the pluggable conductive body 91 defines an annular protruding portion (not shown) sleeving the outer surface of the third pluggable conductive member 83, the protruding portion engages with the third pluggable conductive member 83 by an interference fit, to ensure reliability of electrical connection between the third pluggable conductive member 83 and the pluggable conductive body 91. Alternatively, a partial cross section or a whole cross section of the pluggable conductive body 91 may be flat, the pluggable conductive body 91 engages with the third pluggable conductive member 83 by an interference fit to clamp the third pluggable conductive member 83, to ensure reliability of electrical connection between the third pluggable conductive member 83 and the pluggable conductive body 91.

In combination with FIGS. 2-4, the assembly of the electronic cigarette includes following steps:

The pair of conductive pipes 50 are provided. The conductive pipe 50 includes the first open end 51, the second open end 52, and the partition wall 53. The partition wall 53 is disposed within the middle of the conductive pipe 50 to separate the first open end 51 from the second open end 52. Alternatively, the partition wall 53 is only disposed within one of the conductive pipe 50, sealing partition structure such as occlusion is disposed within the middle of the other conductive pipe 50.

The conductive pipes 50 are inserted longitudinally into the atomizer device mounting base 40. Preferably, the conductive pipes 50 are embedded into to the atomizer device mounting base 40 to form an integral structure by embedded injection molding.

The atomizer device 60 is provided. Preferably, the liquid reservoir 70 is further provided. Two first pluggable conductive members 63 of the atomizer device 60 are embedded into the liquid reservoir 70, and extend out of the bottom end of the liquid reservoir 70. The first pluggable conductive members 63 are inserted into the first open ends 51 of the conductive pipes 50. The liquid reservoir 70 may engage with the atomizer device 60 in other ways.

Preferably, the following step is further included. The first open end 51 is deformed (such as, clamped to be flat) by a tool such as a clamp forceps, to force the first open end 51 to tightly clamp the first pluggable conductive member 63, whereby ensuring reliability of electrical connection between the first pluggable conductive member 63 and the first open end 51.

Furthermore, the assembly includes the following step:

The battery device 80 is provided. The battery device 80 includes two second pluggable conductive members 82 facing the atomizer device mounting base 40 and three third pluggable conductive members 83, and the second pluggable conductive members 82 is inserted into the second open end 52 of the conductive pipe 50 to achieve electrical connection therebetween.

Preferably, the following steps are further included. The second open end 52 is deformed (such as, clamped to be flat) by a tool such as a clamp forceps, to force the second open end 52 to tightly clamp the second pluggable conductive member 82, whereby ensuring reliability of electrical connection between the second pluggable conductive member 82 and the second open end 52.

The air switch 90 is provided. The air switch 90 includes the three pluggable conductive bodies 91, the three third pluggable conductive members 83 are inserted into the three pluggable conductive bodies 91 respectively.

A tool such as a clamp forceps is used to deform the open of the pluggable conductive bodies 91 to tightly clamp the third pluggable conductive members 83, to ensure reliability of electrical connection between the third pluggable conductive members 83 and the pluggable conductive bodies 91.

The liquid reservoir 70, the atomizer device 60, the atomizer device 40, the conductive pipe 50, the battery device 80, and the air switch 90 are installed together as an assembly to be inserted into the housing 10, then the mouthpiece 20 and the end cover 30 cover opposite ends of the housing 10 respectively. At this point, the assembly of the electronic cigarette is finished.

It is noteworthy that, the above-mentioned technical features can be used in any combination without restriction.

The disclosure described above of the present invention is illustrative but not restrictive scope of the present invention. Any equivalent structure, or equivalent process transformation, or directly or indirectly usage in other related technical field, all those be made in the same way are included within the protection scope of the present invention.

What is claimed is:

1. An electronic cigarette comprising: an atomizer device mounting base (40); at least one conductive pipe (50) extending longitudinally through the atomizer device mounting base (40), wherein the at least one conductive pipe (50) comprises a first open end (51), a second open end (52), and a partition wall (53), the partition wall (53) is disposed within the middle of the at least one conductive pipe (50) to separate the first open end (51) from the second open end (52); an atomizer device (60) comprising at least one first pluggable conductive member (63), wherein the at least one first pluggable conductive member (63) is inserted into and electrically connected to the first open end (51) of the at least one conductive pipe (50); and a battery device (80) comprising at least one second pluggable conductive member (82), wherein the at least one second pluggable conductive member (82) is inserted into and electrically connected to the second open end (52) of the at least one conductive pipe (50).

2. The electronic cigarette as described in claim 1, wherein the at least one conductive pipe (50) comprises a pair of conductive pipes (50) extending longitudinally through the atomizer device mounting base (40) respectively, each of the pair of conductive pipes (50) comprises opposite first open end (51) and second open end (52), and a partition wall (53) disposed within the middle of the conductive pipe (50), the partition wall (53) separates the first open end (51) from the second open end (52); the atomizer device (60) comprises a pair of first pluggable conductive members (63), the pair of first pluggable conductive members (63) are respectively inserted into and electrically connected to the first open ends (51) of the pair of conductive pipes (50); the battery device (80) comprises a pair of second pluggable conductive members (82), the pair of second pluggable conductive members (82) are respectively inserted into and electrically connected to the second open ends (52) of the pair of conductive pipes (50).

3. The electronic cigarette as described in claim 2, wherein the pair of conductive pipes (50) are symmetrically arranged at the atomizer device mounting base (40).

4. The electronic cigarette as described in claim 3, wherein the at least one conductive pipe (50) are embedded into the atomizer device mounting base (40).

5. The electronic cigarette as described in claim 3, wherein the at least one conductive pipe (50) are embedded into the atomizer device mounting base (40) to form a whole structure.

6. The electronic cigarette as described in claim 2, wherein the at least one conductive pipe (50) are embedded into the atomizer device mounting base (40).

7. The electronic cigarette as described in claim 2, wherein the at least one conductive pipe (50) are embedded into the atomizer device mounting base (40) to form a whole structure.

8. The electronic cigarette as described in claim 7, wherein the internal walls of the first open end (51) and of the second end (52) respectively define annular protruding portions which are sleeved on the outer surfaces of the at least one first pluggable conductive member (63) and the at least one second pluggable conductive member (82) respectively, the protruding portion engages with the at least one first pluggable conductive member (63) by an interference fit.

9. The electronic cigarette as described in claim 7, wherein a partial cross section or whole cross sections of the first open end (51) and the second open end (52) are flat, the first open end (51) and the second open end (52) respectively engage with the at least one first pluggable conductive member (63) and the at least one second pluggable conductive member (82) by an interference fit.

10. The electronic cigarette as described in claim 7, wherein end portions of the first open end (51) and the second open end (52) respectively define contracted holes for clamping the at least one first pluggable conductive member (63) and the at least one second pluggable conductive member (82) respectively.

11. The electronic cigarette as described in claim 10, wherein ends of the at least one first pluggable conductive member (63) and the at least one second pluggable conductive member (82) respectively define tapered or frustum-shaped guiding portions.

12. A method for assembling an electronic cigarette, comprising:

providing at least one conductive pipe (50), wherein the at least one conductive pipe (50) comprises a first open end (51), a second open end (52), and a partition wall (53), the partition wall (53) is disposed within the middle of the at least one conductive pipe (50) to separate the first open end (51) from the second open end (52); the at least one conductive pipe (50) extending longitudinally through an atomizer device mounting base (40);

providing an atomizer device (60) comprising at least one first pluggable conductive member (63), wherein the at least one first pluggable conductive member (63) is inserted into and electrically connected to the first open end (51) of the at least one conductive pipe (50).

13. The method as described in claim 12, wherein the at least one conductive pipe (50) are embedded into the atomizer device mounting base (40) to form a whole structure by embedded injection molding.

14. The method as described in claim 12, further comprising: providing a battery device (80) comprising at least one second pluggable conductive member (82) opposite to the atomizer device mounting base (40), wherein the at least one second pluggable conductive member (82) is inserted into and electrically connected to the second open end (52) of the at least one conductive pipe (50).

15. The method as described in claim 14, wherein the providing an atomizer device (60) comprising at least one first pluggable conductive member (63), wherein the at least one first pluggable conductive member (63) is inserted into and electrically connected to the first open end (51) of the at least one conductive pipe (50) further comprises:

deforming the second open end (52) to allow the second open end (52) to clamp the at least one second pluggable conductive member (82) tightly.

16. The method as described in claim 12, wherein the providing an atomizer device (60) comprising at least one first pluggable conductive member (63), wherein the at least one first pluggable conductive member (63) is inserted into and electrically connected to the first open end (51) of the at least one conductive pipe (50) comprises:

deforming the first open end (51) to allow the first open end (51) to clamp the at least one first pluggable conductive member (63) tightly.

* * * * *